US006165950A

United States Patent [19]

Rao et al.

[11] Patent Number: 6,165,950

[45] Date of Patent: Dec. 26, 2000

[54] PHOSPHATE LUBRICANT COMPOSITIONS AND METAL FORMING USE

[75] Inventors: Arvind M. Rao, Manmouth Junction, N.J.; Douglas G. Placek, Yardley, Pa.

[73] Assignee: PABU Services, Inc., Wilmington, Del.

[21] Appl. No.: 09/196,720

[22] Filed: Nov. 20, 1998

Related U.S. Application Data

[60] Provisional application No. 60/066,540, Nov. 26, 1997, abandoned, and provisional application No. 60/066,534, Nov. 26, 1997, abandoned.

[51] Int. Cl.[7] ..... C10M 137/04

[52] U.S. Cl. ..... 508/433; 508/436; 508/438

[58] Field of Search ..... 508/433, 438, 508/436, 437

[56] References Cited

U.S. PATENT DOCUMENTS

| | | | |
|---|---|---|---|
| 3,978,908 | 9/1976 | Klaus et al. | 164/72 |
| 4,362,634 | 12/1982 | Berens et al. | 252/49.5 |
| 4,612,127 | 9/1986 | Takao et al. | 72/42 |
| 4,765,917 | 8/1988 | Otaki et al. | 252/42 |
| 4,822,507 | 4/1989 | Kanamori et al. | 508/438 |
| 5,139,876 | 8/1992 | Graham et al. | 428/411.1 |
| 5,206,404 | 4/1993 | Gunkel et al. | 558/146 |
| 5,495,737 | 3/1996 | Graham | 72/42 |
| 5,584,201 | 12/1996 | Graham et al. | 72/42 |
| 5,616,544 | 4/1997 | Kalota et al. | 508/508 |

FOREIGN PATENT DOCUMENTS 0276568 8/1988 European Pat. Off. .

OTHER PUBLICATIONS

Mortier, R.M. et al. Chemistry and Technology of Lubricants. NY:1992. Blackie and Son Ltd. (VCH Publishers, Inc.). pp. 213–215.

Lubricant Additives, C.V Smallheer and R.K. Smith, Lezius–Hiles Co. Cleveland OH (1967).

Studies of a New Lubricant to Replace Graphite, R. Porter and E. E. Graham, Lubrication Engineering, Dec., 1996, pp. 850–852.

Field Experiences in the Replacement of Graphite in Metal Forming Applications, A. Rao, STLE 1998, May, 1998.

*Primary Examiner*—Margaret Medley
*Assistant Examiner*—Cephia D. Toomer
*Attorney, Agent, or Firm*—Woodard, Emhardt, Naughton, Moriarty & McNett

[57] ABSTRACT

Concentrated lubricant compositions, dilutable for use in high temperature metal forming processes and containing a triaryl phosphate ester; a non-ionic and/or amphoteric surfactant, an organic sulfur-containing extreme pressure additive, an amine salt of an organic acid, and, optionally, sodium thiosulfate, exhibit improved performance in forming operations and produce parts with less part to part variation.

25 Claims, 1 Drawing Sheet

PHOSPHATE LUBRICANT COMPOSITIONS AND METAL FORMING USE

CROSS-REFERENCE TO RELATED APPLICATIONS

Figure 1:
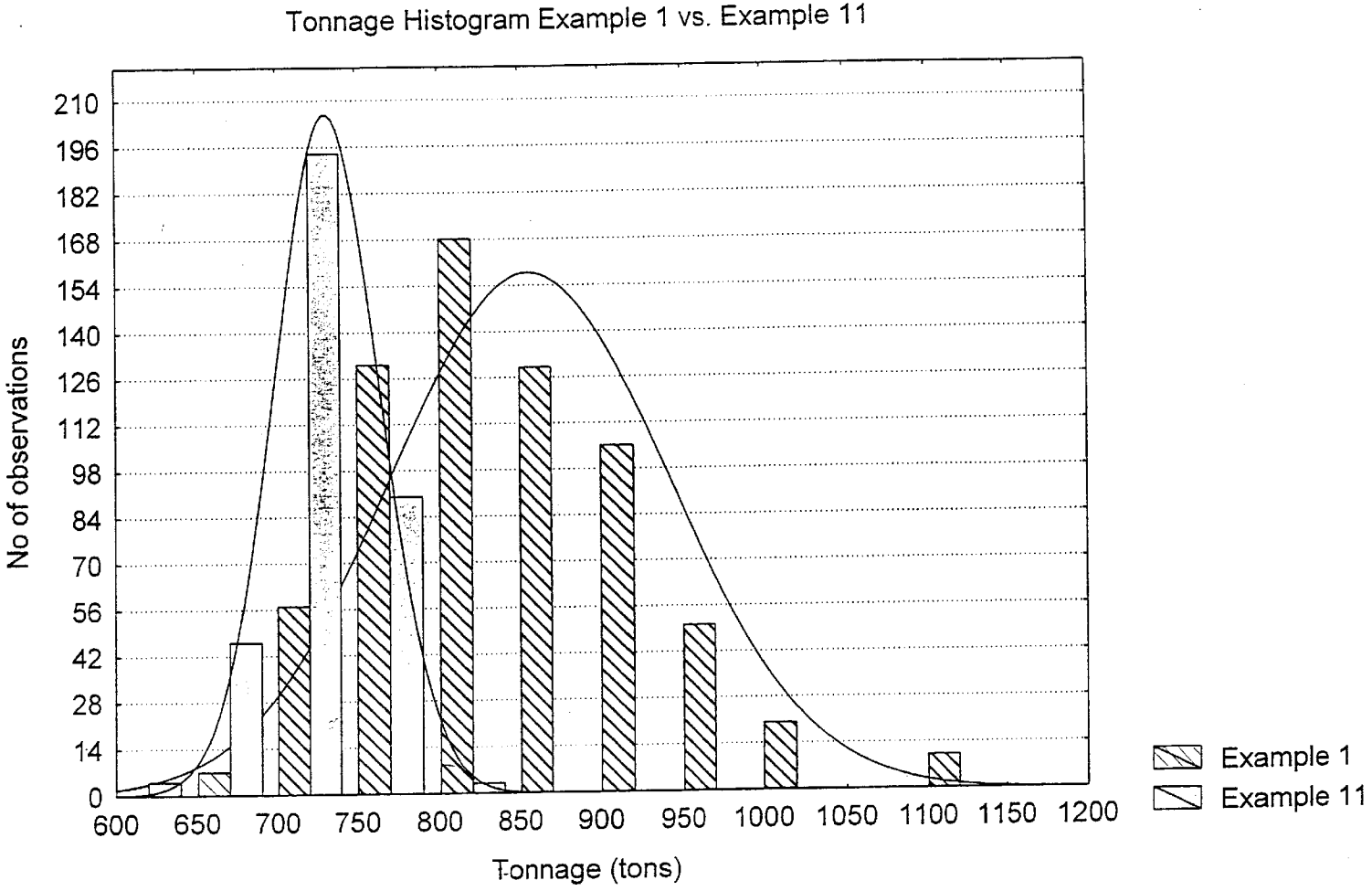

This application claims priority from U.S. Provisional application Ser. No. 60/066,540 and Ser. No. 60/066,534, filed Nov. 26, 1997, both of which are incorporated herein by reference, now abandoned.

TECHNICAL FIELD

This invention relates to lubricant compositions. In particular, this invention relates to concentrated phosphate ester compositions that may be diluted to form diluted lubricant compositions for use in high temperature metal forming processes, in particular in metal forging processes.

BACKGROUND

Metal forming processes may be described as operations in which metal undergoes a plastic deformation to obtain the desired shape of the workpiece. Typically, no metal is removed in a forming process. Examples of metal forming processes include hot and cold rolling, forging (of both ferrous and non-ferrous metals), molding, stamping, casting, ironing, drawing, and extruding. Metal forming processes differ from metal working processes. In metal working processes metal is removed to obtain the desired shape of the workpiece. Examples of metal working processes include cutting, drilling, turning, and milling.

In all the metal forming processes it is necessary to lubricate the surface of the metal and of the tools with which it is being formed. The most commonly used lubricant compositions comprise colloidal suspensions of fine particulate graphite in oil or water. These suspensions are often inconvenient to handle and to deliver to the working surfaces, constitute a health hazard for the operator, and tend to lead to the formation of graphite deposits on the metal or on the tool.

Many other lubricants have been proposed for use in metal forming operations. These include semi-synthetic or synthetic emulsions containing inorganic salts, fatty acid metal soaps, and organic esters.

Klaus, U.S. Pat. No. 3,978,908, describes the introduction of a vaporized lubricant composition to the surface of a die or mold. One preferred class of lubricants described in this patent are the triaryl phosphates, especially tricresyl phosphate.

Graham, U.S. Pat. No. 5,584,201, incorporated herein by reference, describes the use of a water based lubricant composition comprising a tri(alkylaryl)phenyl phosphate and a die release agent to lubricate the surface of a metal forming die. The die release agent is either a binder, such as a. lignosulfonate, a water soluble cellulose compound, or a fatty acid soap. The preferred phosphate ester is a butylated phenyl phosphate ester.

Metal forming lubricant compositions are typically sold as concentrates. These concentrates are emulsions, which are diluted by the user prior to use. The concentrates are prepared by the manufacturer and shipped in drums to the user, who may store the drums of concentrate for several weeks to months prior to use. Because the lubricant properties of the metal forming lubricant composition are typically lost if the lubricant deemulisifies, the emulsion should have a shelf life (stability) at room temperature (about 25° C.) of at least one month, preferably at least six months, and more preferably at least one year. A high temperature (about 75° C.) shelf life of at least one month is preferred.

The water based emulsion concentrates and emulsions described in Graham are unstable. These emulsion concentrates comprise significant quantities of the sodium salt of a fatty acid and separate on standing. This instability is further exacerbated by the presence of inorganic extreme pressure agents. This deterioration diminishes its lubricating properties, requiring the emulsion be disposed of frequently. Thus, a need exists for lubricant compositions for metal forming that exhibit good stability upon prolonged storage and also offer significant advantages in performance.

DISCLOSURE OF THE INVENTION

In one aspect this invention is a concentrated lubricant composition for metal forming that exhibits good stability upon prolonged storage and also offers significant advantages in performance. The invention comprises:

(a) a triaryl phosphate ester;

(b) a non-ionic surfactant;

(c) an organic sulfur-containing extreme pressure additive that reduces the force required for the forming process; and (d) an amine salt selected from the group consisting of amine salts of carboxylic acids, amine salts of polyacrylic acids, and amine salts of partially neutralized esters of phosphoric acid and an ethoxylated alcohol.

In another aspect the invention is diluted lubricant composition. In yet another aspect the invention is a method form forming metal using the lubricant composition.

These lubricant compositions are non-volatile and non-corrosive. They provide superior die release and part movement as well as improved metal movement. Scale development is reduced and buildup is eliminated. They reduce the force (tonnage) required for forming a part as well as the variation in tonnage. Because the variation in part dimensions is a function in tonnage variation, part variation and reject rate are reduced.

FIG. 1 shows the variation in tonnage for two different metal forming lubricant compositions.

Phosphate ester emulsions that comprise fatty acid metal soaps and extreme pressure additives are inherently unstable. However, if a non-ionic or amphoteric surfactant is used in the emulsion together with an organic-sulfur-containing extreme pressure additive, the resulting emulsion is more stable.

Useful phosphate esters are triaryl phosphate esters that are liquids and that, preferably, have a relatively low volatility. These phosphates are generally obtained by the phosphorylation of alkyl phenols, which may be obtained from a natural or a synthetic source. Those obtained from a synthetic source are obtained by the reaction of phenol with an alkene, usually propylene or iso-butylene, to produce a mixture of phenol and alkyl substituted phenol (often termed "a phenol alkylate") and the phosphorylation of such a phenol alkylate. These mixed alkylated triphenyl phosphate esters typical comprise triphenyl phosphate; diphenyl mono (alkylphenyl) phosphate; phenyl di(alkylphenyl) phosphate and tri(alkylphenyl) phosphate. Preparation of mixed synthetic triaryl phosphate esters is described in Randell, U.S. Pat. No. 4,093,680. Purification of aryl phosphate esters is described in Gunkel, U.S. Pat. No. 5,206,404.

The preferred phosphate esters are mixed alkylated triphenyl phosphates comprising about 1 to about 35% by weight, preferably about 15 to about 35% by weight, tri (alkylphenyl) phosphate; about 10 to about 55% by weight, preferably about 30 to 55% by weight, of di(alkylphenyl) monophenyl phosphate; from about 10 to about 60% by weight, preferably about 10 to 25% by weight, of mono (alkylphenyl) diphenyl phosphate and less than about 5% by weight, preferably less than about 2% by weight, of triphenyl phosphate. Preferably the alkyl substituent is iso-propyl (i.e., a phenol alkylate obtained from alkylation of phenol with propylene) or t-butyl (i.e., a phenol alkylate obtained from alkylation of phenol with iso-butylene). Most preferably the alkyl substituent is t-butyl. These phosphates are commercially available.

The surfactant is a non-ionic surfactant an amphoteric surfactant, or a mixture thereof. It is preferably non-volatile, hydrolytically stable, and does not form a residue when degraded by contact with a hot metal surface. It should be capable of forming both a stable concentrate and a stable diluted lubricant composition. It is selected to provide at least the desired degree of emulsion stability. The stability of the emulsion is affected by the nature of the phosphate ester and the nature and quantity of any other ingredients that are incorporated into the composition.

Non-ionic surfactants include fatty alcohol ethoxylates, fatty amine ethoxylates, alkanolamine ethoxylates, sorbitan ester ethoxylates (such as those available under the designations Tween® 20, Tween® 40, Tween® 60, Tween® 80, and Tween® 85), alkyl phenol ethoxylates, and other compounds such as disclosed in *Industrial Applications of Surfactants,* D. R. Karsa, ed., The Royal Society of Chemistry, London, 1987, and similar textbooks.

A preferred class of surfactants are the alkyl phenol ethoxylates, especially ethoxylated alkyl phenols containing at least six moles of ethylene oxide per mole of alkyl phenol. These surfactants are available under such designations as Sellig 06-100, Sellig 08-100, Sellig 09-100, Sellig 011-100, Selling 012-100, Triton® X-100, Triton® X-114 and Triton® X120. Another group of preferred surfactants are ethoxylated castor oils, such as those available under the designations Surfactol 365 and Witconol CO-360.

Extreme pressure additives reduce the force required for the forming process. This reduces wear and tear on the machine and die.

Useful organic-sulfur-containing extreme pressure additives include sulfur containing compounds known to be useful as extreme pressure additives in lubricant compositions. These additives are "organic" additives, i.e., compounds that do not dissociate in aqueous media to form ionic species to any significant degree. Examples of useful sulfur containing additives include sulfurized olefins; phosphinothio(thio)propanoic acid alkyl esters, such as those sold as Irgalube® 63 (Ciba); phosphorthionate esters, such as triphenyl phosphorthionate, sold as Irgalube® TPPT (Ciba); and other alkylated phenyl phosphorthionates, such as those sold as Irgalube® 211 (Ciba).

If a phosphorthionate is used as the extreme pressure additive, care must be taken in the selection of the non-ionic surfactants if the resulting emulsion is to have the preferred degree of stability. The amount used should not be such to render the emulsion formed by diluting the concentrate unstable. If a particular emulsion has less than acceptable stability properties, it may be preferable to select another organic-sulfur-containing extreme pressure additive or to use a different amount of the additive.

"Inorganic" additives, such as calcium (or sodium) lignosulfonate, proposed in Graham, U.S. Pat. No. 5,584, 201, zinc salts, such as zinc thiophosphonate, and polysulfides, such as sodium polysulfide, are not useful. Lignosulfonates produce an emulsion that is less stable and which may be less effective as a lubricant. Zinc salts contain a heavy metal. Polysulfides have odor problems.

The metal forming lubricant composition comprises an amine salt of a carboxylic acid, amine salt of a polyacrylic acid, or an amine salt of a partially neutralized ester of phosphoric acid and an ethoxylated alcohol. These amine salts improve both the stability and the lubricating properties of the compositions.

Suitable carboxylic acids include mono- and polyaliphatic or aromatic carboxylic acids comprising at least 6 carbon atoms known to be useful in the art of metal working lubrication. Suitable carboxylic acids include, for example, stearic acid, oleic acid, adipic acid, sebacic acid and isophthalic acid. Suitable polyacrylic acids include high molecular weigh polyacrylic acid, crosslinked with polyalkenyl polyether, such as those produced by B.F. Goodrich under the designations Carbopol® and Pemulin. Suitable ethoxylated phosphoric acids include mono- and dialkyl- or arylphosphoric acid ethoxylates such as those sold under the designation Actrophos SP407. Suitable amines to prepare the salt, include, for example, ammonia and alkanolamines, especially triethanolamine.

In general, the addition of inorganic compounds should be avoided. Although inorganic cations tends to destabilise the emulsion, it has surprisingly been found that sodium thiosulfate can be added to the emulsion as a performance aid without destroying its stability. Other equivalent thiosulfate salts, such as ammonium thiosulfate, alkyl ammonium thiosulfates, etc., may also be used. With the exception of sodium thiosulfate, the concentrates and the diluted emulsions are preferably substantially free from inorganic ions.

The lubricant compositions may further comprise one or more additional components conventional in the art, such as antifungal agents, antibacterial agents, dyes, corrosion inhibitors, etc. The nature of these components and the amounts in which they are present is governed by the intended use of the composition. Generally, these additional components comprise less than five weight percent of the concentrate. These additional components will preferably be introduced into the concentrate wherever possible. Alternatively, they may be mixed into the emulsion after the concentrate is diluted but before it is used.

These lubricant compositions may be conveniently manufactured and sold as concentrates, which may be diluted with water prior to use. The concentrates are either aqueous and non-aqueous. The pH of the concentrate is alkaline, preferably about 8.0 to about 9.0, and more preferably 8.5. When necessary, additional organic base can be added to bring the pH within the preferred range. Typically about 3% to about 5% of organic base is added to control pH. The preferred organic bases are the alkanolamines, especially triethanolamine. Inorganic bases should not be used to raise the pH of the concentrate.

The concentrates are typically emulsions that are stable on prolonged storage. These emulsions have a shelf-life (stability) of at least 20 days, preferably at least 45 days, and more preferably more than 100 days.

The concentrate typically contains from about 1 to about 50% by weight, preferably about 5 to about 30% by weight, of phosphate ester. The amount of extreme pressure additive in the concentrate is preferably about 2% to 15% by weight of the concentrate. The amount of non-ionic surfactant(s) will generally be proportioned to the amount of phosphate ester. The ratio of the weight of phosphate to the weight of surfactant(s) will usually be about 0.5:1 to 200:1, more usually 1:1 to 10:1. The amount of non-ionic surfactant(s) is typically about 5% to about 35% by weight. The ratio of a phosphate ester to amine salt is about 0.5:1 to 10:1. When a polyacrylic acid is used as the organic acid, about 0.4% to about 1.5% of polyacrylic acid is typically added. Up to about 7%, typically about 2% to about 7%, more typically about 5%, of sodium thiosulfate may also be present.

In use, the concentrate is diluted to form a diluted lubricant composition. Dilution is typically about 1 part of concentrate to about 100 parts diluted composition (i.e., about 1% concentrate in the diluted composition) to about 1 part of concentrate to about 10 parts diluted composition (i.e., about 10% concentrate in the diluted composition). The degree of dilution will vary with the composition of the concentrate (i.e.,, the amount of triaryl phosphate ester in the concentrate, etc.), nature and severity of the metal forming operation, and the manner in which the lubricant emulsion is to be applied.

A diluted lubricant composition can be prepared by dispersing the concentrate in water with the aid of strong agitation provided by conventional impellers or ultrasonic devices. Although this composition is described as a "diluted lubricant composition," it can, of course, be prepared directly by mixing the components in the required amounts instead of diluting a pre-prepared lubricant concentrate. Because the diluted lubricant composition is typically used relatively quickly after soon after it is prepared, it does not have to have a long shelf life. An emulsion stability of several days is typically adequate.

Diluted lubricant compositions typically comprise from 0.01% to 5.0%, preferably 0.5% to 1.5%, by weight of triaryl phosphate ester. The other components are in proportion to the concentration of the triaryl phosphate ester.

INDUSTRIAL APPLICABILITY

The compositions are particularly useful as lubricants in high temperature metal forming processes. These lubricants are generally applicable to the forming of ferrous and non-ferrous metals and alloys, especially carbon steel. The compositions are useful for forming with either hydraulic or hammer presses.

The essential steps in the forge lubricant process are: (1) contacting the working surfaces of the die with the diluted lubricant composition; (2) forming the preheated metal workpiece in the die; and (3) removing the formed workpiece from the die. It is preferred to flood the die with large volume of diluted lubricant composition by any conventional manner, such as spraying, coating, etc. The die is generally preheated to least 250° C. and the workpiece is normally preheated to at least 800° C. This is an extremely stressful environment, and we have discovered that the lubricant compositions provide improved lubrication under these conditions apparently because of their improved thermal stability.

The advantageous properties of this invention can be observed by reference to the following examples which illustrate, but do not limit, the invention.

EXAMPLES

| Glossary | |
|---|---|
| BPP | Mixture of tri(t-butylphenyl)phosphate, di(t-butylphenyl)monophenyl phosphate, mono(t-butylphenyl)diphenyl phosphate, triphenyl phosphate (FMC Corporation). |

-continued

| Glossary | |
|---|---|
| Irgalube ® TPPT | Triphenyl phosphorthionate (Ciba) |
| Surfactol 365 | Ethoxylated castor oil containing about 40 moles of ethylene oxide (Caschem) |
| CO-360 | Witconol CO-360; ethoxylated castor oil containing about 36 moles of ethylene oxide (Witco) |
| Pemulin TR2 | High molecular weight polyacrylic acid, crosslinked with polyalkenyl polyether (B. F. Goodrich) |
| SP 407 | Actrophos SP 407; ethoxylated aryl acid phosphate (Climax Lubricants) |
| Triton ® X-100 | Nonylphenol ethoxylate (Union Carbide) |
| Tween ® 20 | Polyoxyethylene sorbitan monolaurate (ICI) |
| Tween ® 80 | Polyoxyethylene sorbitan monooleate (ICI) |

Examples 1–16

Concentrate preparation

A series of compositions was made up having the compositions described in Tables 1–4. Concentrates were prepared by the following procedure: (1) the phosphate ester and the extreme pressure additives were combined with gentle heating (50° C.) and agitation, (2) the carboxylic acid, ethoxylated phosphoric acid, or polyacrylic acid was added, and (3) the non-ionic surfactant(s) was added. Then, if the concentrate is an aqueous concentrate, water was added. Finally the amine was added. The concentrate was mixed with sufficient agitation, heat and time to ensure the incorporation of the components into a stable concentrate.

Sample Evaluation

The stability of the concentrate was assessed by noting the separation of a solid phase from the concentrate. The LT/RT cycle involved storing the emulsion at low temperature for 16 hr and at room temperature for 8 hr. The LT/RT evaluation was carried out for a maximum of 5 days, i.e., 5 cycles. For the high temperature evaluation, a graduated cylinder containing 100 mL of emulsion was placed in an oven at 75° C. and the time required for 5 mL of solution to separate determined.

Forging performance was assessed using a commercial graphite-based lubricant composition lubricant composition as a standard. Metal movement, part release and die build up were assessed by the operator of the forge on the basis of the performance of the composition in a prolonged forging operation of carbon steel. Ratings are as follows: v. good—produced in-spec, usable parts; good—produced in-spec useable parts; okay—produced in-spec. useable parts; poor—did not produce useable parts; heavy—frequent (once a shift) down time and scale disposal cost; light—some down time and scale disposal cost; minimal—no down time and minimal scale disposal cost; none—no down time or scale disposal cost. In the Tables "nd" means not determined.

Comparative Examples

Example 1 is an example of a commercial graphite-based lubricant composition. Example 2 is the composition disclosed at column 5, line 12, of Graham, U.S. Pat. No. 5,584,201, incorporated herein by reference. This composition contains: 2 parts (by weight) alkanol amine (triethanol amine), 1 part biocide, 5 parts calcium lignosulfonate, 5 parts sodium thiosulfate, 5 parts utylammonium dihydrogen phosphate, 7 parts Durad 620B hosphate ester, 1 part cellulose binder (carboxymethyl cellulose, sodium salt), 42 parts water, 1 part fatty acid ethoxalate (ethoxylated tall-oil), 1 part glyceride tall oil, and 30 parts fatty acid soap (adipic acid and sodium hydroxide). Examples 3 and 4 are comparative example in which the amine salt of an organic acid is absent.

TABLE 1

| Component | 1 | 2 | 3 | 4 |
|---|---|---|---|---|
| Colloidal Graphite | 100 | — | — | — |
| Control[a] | — | 100 | — | — |
| Metal forming agents | | | | |
| BPP | — | — | 50 | 40 |
| Irgalube ® TPPT | — | — | — | 10 |
| Non-ionic surfactants | | | | |
| Tween ® 80 | — | — | 50 | 50 |
| Concentrate Type | nonaq. | nonaq. | nonaq. | nonaq. |
| Concentrate Stability (days) | | | | |
| RT (25° C.) | <1 | 4 | 3 | 3 |
| LT/RT (−15° C./25° C.) | nd | 1 | 2 | 2 |
| HT (75° C.) | nd | <1 | <1 | <1 |
| % Concentration[b] | 10 | 10 | 1 | 1 |
| Forging Performance | | | | |
| Forming Load[c] | — | 11.8 | 5.9 | 8.0 |
| Metal movement[d] | 16 | 15 | 13 | nd |
| Part release[e] | 0 | 1 | 0 | 0 |
| Coating | good | okay | good | good |
| Part Fill | good | good | good | good |
| Scale | heavy | light | minimal | minimal |
| Die Build-up | some | some | none | none |

[a]U.S. Pat. No. 5,584,201 (see above).
[b]Percent of concentrate in diluted lubricant composition.
[c]Percent reduction from graphite.
[d]Problems/100 parts.
[e]Problems/100 parts.

Examples 5–8 are non-aqueous compositions of the invention.

TABLE 2

| Component | 5 | 6 | 7 | 8 |
|---|---|---|---|---|
| Metal forming agents | | | | |
| BPP | 20 | 20 | 20 | 20 |
| Irgalube ® TPPT | 10 | 10 | 10 | 10 |
| Amine salts of Organic Acids | | | | |
| Stearic Acid | — | 10 | — | — |
| Oleic acid | 20 | — | — | — |
| Adipic Acid | — | — | 10 | — |
| Sebacic Acid | — | — | — | 10 |
| SP 407 | 5 | 10 | 10 | 10 |
| Triethanol amine | 20 | 20 | 20 | 20 |
| Non-ionic surfactants | | | | |
| Tween ® 20 | 25 | — | — | — |
| CO-360 | — | 10 | 10 | 10 |
| Surfactol 365 | — | 20 | 20 | 20 |
| Water (%) | 0 | 0 | 0 | 0 |
| Concentrate Type | non-aq. | non-aq. | non-aq. | non-aq. |
| Emulsion Stability (days) | | | | |
| RT (25° C.) | 100+ | 100+ | 25 | 20 |
| LT/RT (−15° C./25° C.) | 5+ | 5+ | 3 | 3 |
| HT (75° C.) | 5 | nd | nd | nd |
| % Concentration[b] | 5 | 5 | 5 | 5 |

TABLE 2-continued

| Component | 5 | 6 | 7 | 8 |
|---|---|---|---|---|
| Forging Performance | | | | |
| Forming Load[c] | 8.0 | 8.0 | nd | nd |
| Part release[e] | 0 | nd | nd | nd |
| Coating | good | nd | nd | nd |
| Part Fill | good | nd | nd | nd |
| Scale | minimal | nd | nd | nd |
| Die Build-up | none | nd | nd | nd |

[b]Percent of concentrate in diluted lubricant composition.
[c]Percent reduction from graphite.
[e]Problems/100 parts.

Examples 9–11 are comparison examples that do not contain an amine salt of an organic acid. Example 12 is an aqueous composition of the invention. Each of these compositions contains sodium thiosulfate.

TABLE 3

| Component | 9 | 10 | 11 | 12 |
|---|---|---|---|---|
| Metal forming agents | | | | |
| BPP | — | 8 | 8 | 8 |
| Irgalube ® TPPT | — | — | 2 | 2 |
| Sodium thiosulfate | — | 5 | 5 | 5 |
| Amine salts of Organic Acids | | | | |
| Pemulin TR2 | — | — | — | 0.75 |
| Triethanol amine | — | — | — | 3.5 |
| Non-ionic surfactants | | | | |
| Triton ® X100 | — | 5 | 5 | 7.5 |
| CO-360 | 5 | — | — | 2.5 |
| Surfactol 365 | 5 | 5 | 5 | — |
| Water (%) | 90 | 77 | 75 | 70.25 |
| Concentrate Type | aqueous | aqueous | aqueous | aqueous |
| Emulsion Stability (days) | | | | |
| RT (25° C.) | 100+ | 24 | 24 | 45+ |
| LT/RT (−15° C./25° C.) | 5+ | 5+ | 5+ | 5+ |
| HT (75° C.) | 3 | <1 | <1 | 45+ |
| % Concentration[b] | 10 | 10 | 10 | 10 |
| Forging Performance | | | | |
| Forming Load[c] | 11.8 | 13.6 | 14.1 | 14.3 |
| Metal movement[d] | 32 | 11 | 1 | 1 |
| Part release[e] | 5 | 0 | 0 | 0 |
| Coating | okay | good | good | good |
| Part Fill | poor | good | v. good | v. good |
| Scale | heavy | minimal | minimal | minimal |
| Die Build-up | none | none | none | none |

[b]Percent of concentrate in diluted lubricant composition.
[c]Percent reduction from graphite.
[d]Problems/100 parts.
[e]Problems/100 parts.

Examples 13–16 are compositions of the invention. Each of these examples contains sodium thiosulfate.

TABLE 4

| Component | 13 | 14 | 15 | 16 |
|---|---|---|---|---|
| Metal forming agents | | | | |
| BPP | 8 | 8 | 8 | 8 |
| Irgalube ® TPPT | 2 | 2 | 2 | 2 |
| Sodium Thiosulfate | 5 | 5 | 5 | 5 |

TABLE 4-continued

| Component | 13 | 14 | 15 | 16 |
|---|---|---|---|---|
| Organic Acid | | | | |
| Pemulin TR2 | 0.5 | 0.25 | 0.25 | 0.75 |
| Triethanol Amine | 3.5 | 3.5 | 3.5 | 3.5 |
| Non-ionic surfactants | | | | |
| Triton ® X | 5 | 2.5 | 7.5 | 2.5 |
| CO-360 | 5 | 2.5 | 7.5 | 7.5 |
| Water (%) | 71 | 76.25 | 66.25 | 70.75 |
| Concentrate Type | aqueous | aqueous | aqueous | aqueous |
| Concentrate Stability (days) | | | | |
| RT (25° C.) | 45+ | 26 | (f) | 13 |
| LT/RT (−15° C./25° C.) | 5+ | 3 | (f) | 2 |
| HT (75° C.) | 2 | 2 | (f) | 1 |

[f]No emulsion formed.

Example 17

The tonnage standard deviation was determined for several diluted lubricant compositions. Although none of these examples contain the amine salt, examples 4 and 10 show the improvement when the organic sulfur-containing extreme pressure additive is added. Example 11 shows the additional improvement when sodium thiosulfate is added.

TABLE 5

| | Tonnage - St. Dev. | | Part - St. Dev. | |
|---|---|---|---|---|
| Example | (tons) | (metric tons) | (in) | (cm) |
| 1 | 95 | 95 | 0.008 | 0.020 |
| 2 | 51 | 51 | 0.003 | 0.008 |
| 4 | 42 | 42 | 0.002 | 0.005 |
| 10 | 37 | 37 | 0.002 | 0.005 |
| 11 | 33 | 33 | 0.001 | 0.003 |

In FIG. 1 shows the tonnage variation histogram for Example 1 (graphite) and for the lubricant composition of Example 11. The lubricant composition of Example 11 produces a much smaller tonnage variation and a much lower average tonnage. Because the variation in part size is a function of tonnage variation, a much smaller variation in part size is produced by the lubricant composition of Example 11.

Having described the invention, we now claim the following and their equivalents.

What is claimed is:

1. A concentrated lubricant composition for metal forming, the composition comprising:

(a) about 1% to about 50% by weight of at least one triaryl phosphate ester;

(b) about 5% to about 35% by weight of a non-ionic surfactant, an amphoteric surfactant or a mixture thereof;

(c) about 2% to about 15% by weight of an organic sulfur-containing extreme pressure additive that reduces the force required for the forming process;

(d) an amine salt selected from the group consisting of amine salts of carboxylic acids, amine salts of polyacrylic acids, and amine salts of partially neutralized esters of phosphoric acid and ethoxylated alcohols; and (e) sodium thiosulfate;

in which:

the ratio of triaryl phosphate esters to amine salts is about 0.50:1 to about 10:1, and wherein said composition is an emulsion that has a room temperature shelf life of at least 20 days.

2. The composition of claim 1 in which the composition is a non-aqueous emulsion.

3. The composition of claim 1 in which the composition is an aqueous emulsion.

4. The composition of claim 1 in which the composition comprises from 5.0% to 50.0% by weight of triaryl phosphate ester.

5. The composition of claim 4 in which the triaryl phosphate ester is alkylated triaryl phosphate ester.

6. The composition of claim 5 in which the organic sulfur-containing extreme pressure additive is selected from the group consisting of sulfurized olefins, phosphinothio (thio)propanoic acid alkyl esters, phosphorthionate esters, and alkylated phenyl phosphorthionates.

7. The composition of claim 6 in which the surfactant is non-ionic and is selected from the group consisting of ethoxylated alkyl phenols containing at least six moles of ethylene oxide per mole of alkyl phenol and ethoxylated castor oil.

8. The composition of claim 7 in which the amine salt is selected from the group consisting of amine salts of. aliphatic mono- and poly-carboxylic acids comprising at least 6 carbon atoms, amine salts of aromatic mono- and poly-carboxylic acids comprising at least 6 carbon atoms, amine salts of polyacrylic acids crosslinked with polyalkenyl polyether, and amine salts ethoxylated phosphoric acids.

9. The composition of claim 8 in which the composition is a non-aqueous emulsion.

10. The composition of claim 8 in which the composition is an aqueous emulsion.

11. The composition of claim 1 in which the triaryl phosphate ester in alkylated triaryl phosphate ester.

12. The composition of claim 11 in which the organic sulfur-containing extreme pressure additive is selected from the group consisting of sulfurized olefins, phosphinothio (thio)propanoic acid alkyl esters, phosphorthionate esters, and alkylated phenyl phosphorthionates.

13. The composition of claim 12 in which the surfactant is non-ionic and is selected from the group consisting of ethoxylated alkyl phenols containing at least six moles of ethylene oxide per mole of alkyl phenol and ethoxylated castor oil.

14. The composition of claim 13 in which the amine salt is selected from the group consisting of amine salts of aliphatic mono- and poly-carboxylic acids comprising at least 6 carbon atoms, amine salts of aromatic mono- and poly-carboxylic acids comprising at least 6 carbon atoms, amine salts of polyacrylic acids crosslinked with polyalkenyl polyether, and amine salts ethoxylated phosphoric acids.

15. The composition of claim 14 in which the composition is an aqueous emulsion.

16. The composition of claim 14 in which the composition is a nonaqueous emulsion.

17. A diluted lubricant composition for metal forming, the composition comprising:

(a) about 0.01% to about 5% by weight of a mixture of alkylated triaryl phosphate esters comprising from 1.0% to 20.0% by weight of tri(butylphenyl) phosphate; from 10.0% to 50.0% by weight of di(butylphenyl)monophenyl phosphate; from 15% to 60% by weight of mono(butylphenyl)diphenyl phosphate and less than 5.0% by weight of triphenyl phosphate;

(b) about 0.05% to about 3.5% by weight of a non-ionic surfactant, an amphoteric surfactant or a mixture thereof;

(c) about 0.02% to about 1.5% by weight of an organic sulfur-containing extreme pressure additive that reduces the force required for the forming process; and (d) an amine salt selected from the group consisting of amine salts of carboxylic acids, amine salts of polyacrylic acids, and amine salts of partially neutralized esters of phosphoric acid and ethoxylated alcohols;

in which:

the ratio of alkylated triaryl phosphate esters to amine salts is about 0.50:1 to about 10:1.

18. The composition of claim 17 in which the organic sulfur-containing extreme pressure additive is selected from the group consisting of sulfurized olefins, phosphinothio (thio)propanoic acid alkyl esters, phosphorthionate esters, and alkylated phenyl phosphorthionates.

19. The composition of claim 18 in which the non-ionic surfactant comprises a surfactant selected from the group consisting of ethoxylated alkyl phenols containing at least six moles of ethylene oxide per mole of alkyl phenol and ethoxylated castor oil.

20. The composition of claim 19 in which the amine salt is selected from the group consisting of amine salts of aliphatic mono- and poly-carboxylic acids comprising at least 6 carbon atoms, amine salts of aromatic mono- and poly-carboxylic acids comprising at least 6 carbon atoms, amine salts of polyacrylic acids crosslinked with polyalkenyl polyether, and amine salts ethoxylated phosphoric acids.

21. The composition of claim 17 additionally comprising sodium thiosulfate.

22. The composition of claim 21 in which the organic sulfur-containing extreme pressure additive is selected from the group consisting of sulfurized olefins, phosphinothio (thio)propanoic acid alkyl esters, phosphorthionate esters, and alkylated phenyl phosphorthionates; the non-ionic surfactant comprises a surfactant selected from the group consisting of ethoxylated alkyl phenols containing at least six moles of ethylene oxide per mole of alkyl phenol and ethoxylated castor oil; the acid of the amine salt is selected from the group consisting of mono- and poly-aliphatic or aromatic carboxylic acids comprising at least 6 carbon atoms, polyacrylic acids crosslinked with polyalkenyl polyether, and ethoxylated phosphoric acids.

23. A method for forming metal, the method comprising:

(1) contacting a working surface of a die with a diluted lubricant composition;

(2) forming a metal workpiece preheated to at least 800° C. in the die preheated to at least 250° C. to form a formed workpiece; and (3) removing the formed workpiece from the die;

in which the diluted lubricant composition comprises:

(a) about 0.01% to about 5% by weight of at least one alkylated triaryl phosphate ester;

(b) about 0.05% to about 3.5% by weight of at least one non-ionic surfactant selected from the group consisting of: ethoxylated alkyl phenols containing at least six moles of ethylene oxide per mole of alkyl phenol and ethoxylated castor oil;

(c) about 0.02% to about 1.5% by weight of an organic sulfur-containing extreme pressure additive selected from the group consisting of: sulfurized olefins, phosphinothio(thio)propanoic acid alkyl esters, phosphorthionate esters, and alkylated phenyl phosphorthionates, said extreme pressure additives reducing the force required for the forming process; and (d) an amine salt selected from the group consisting of: amine salts of aliphatic mono- and poly-carboxylic acids comprising at least 6 carbon atoms, amine salts of aromatic mono- and poly-carboxylic acids comprising at least 6 carbon atoms, amine salts of polyacrylic acids crosslinked with polyalkenyl polyether, and amine salts of ethoxylated phosphoric acids;

in which the ratio of alkylated triaryl phosphate esters to amine salts is about 0.50:1 to about 10:1.

24. The method of claim 23 in which the diluted lubricant composition additionally comprises sodium thiosulfate.

25. The method of claim 23 in which the workpiece comprises carbon steel.

* * * * *